US009817324B2

(12) United States Patent
Kitamura et al.

(10) Patent No.: US 9,817,324 B2
(45) Date of Patent: Nov. 14, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Wataru Kitamura, Abiko (JP); Kenichi Ikari, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/413,758

(22) Filed: Jan. 24, 2017

(65) Prior Publication Data

US 2017/0219942 A1 Aug. 3, 2017

(30) Foreign Application Priority Data

Jan. 28, 2016 (JP) ..... 2016-014642

(51) Int. Cl.
*G03G 15/00* (2006.01)
*G03G 5/043* (2006.01)
*G03G 21/18* (2006.01)

(52) U.S. Cl.
CPC ..... *G03G 5/043* (2013.01); *G03G 21/18* (2013.01)

(58) Field of Classification Search
USPC ..... 399/107, 110, 111, 116, 130, 159
See application file for complete search history.

(56) References Cited

U.S. PATENT DOCUMENTS

| | | | |
|---|---|---|---|
| 5,876,890 | A | 3/1999 | Kitamura et al. |
| 5,912,098 | A | 6/1999 | Tanaka et al. |
| 6,405,005 | B1 | 6/2002 | Kitamura et al. |
| 7,266,329 | B2 | 9/2007 | Matsuo et al. |
| 7,645,547 | B2 | 1/2010 | Okuda et al. |

(Continued)

FOREIGN PATENT DOCUMENTS

| | | |
|---|---|---|
| JP | 2010-026240 | 2/2010 |
| JP | 2010-250355 | 11/2010 |

OTHER PUBLICATIONS

U.S. Appl. No. 15/265,995, filed Sep. 15, 2016, Mai Murakami.
U.S. Appl. No. 15/315,869, filed Dec. 2, 2016, Koji Takahashi.
U.S. Appl. No. 15/506,319, filed Feb. 24, 2017, Wataru Kitamura.

*Primary Examiner* — Hoan Tran
(74) *Attorney, Agent, or Firm* — Fitzpatrick Cella Harper and Scinto

(57) ABSTRACT

An electrophotographic photosensitive member, a process cartridge and an electrophotographic apparatus wherein a streak-like image defect otherwise occurring in output in a low printing mode performed under a H/H environment can be reduced are provided. A surface of the photosensitive member has a convex and concave portions continuously in a peripheral direction of the photosensitive member, and alternately in an axial direction of the photosensitive member, a width w of the concave portion is 30 to 100 μm, a depth d of the concave portion is 1 to 5 μm, the convex portion has a rising slope and a descending slope in the peripheral direction of the photosensitive member, and a distance from a starting point of the rising slope to an end point of the descending slope and a distance from a starting point of the descending slope to an end point of the rising slope are 300 μm or less.

12 Claims, 7 Drawing Sheets

CROSS-SECTIONAL VIEW OF CONVEX PORTION IN AXIAL DIRECTION

(56) References Cited

U.S. PATENT DOCUMENTS

| | | | | |
|---|---|---|---|---|
| 7,655,370 | B2 | 2/2010 | Kitamura et al. | |
| 9,098,006 | B2 * | 8/2015 | Uematsu | G03G 15/0233 |
| 2014/0004450 | A1 | 1/2014 | Tokimitsu et al. | |
| 2016/0327876 | A1 | 11/2016 | Miyauchi et al. | |

* cited by examiner

CROSS-SECTIONAL VIEW OF CONVEX PORTION IN AXIAL DIRECTION

CROSS-SECTIONAL VIEW OF CONVEX PORTION IN PERIPHERAL DIRECTION

ANOTHER CROSS-SECTIONAL VIEW OF CONVEX PORTION IN PERIPHERAL DIRECTION

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a process cartridge and an electrophotographic apparatus.

Description of the Related Art

Since an electrical external force and a mechanical external force for charging and cleaning are applied to a surface of an electrophotographic photosensitive member, the electrophotographic photosensitive member is required to have durability (such as wear resistance) against such external force.

In order to meet such a requirement, an improvement technique of using, in a surface layer of an electrophotographic photosensitive member, a resin having high wear resistance (such as a curable resin) has been conventionally employed.

On the other hand, an example of a problem occurring because of the increased wear resistance of a surface of the electrophotographic photosensitive member includes degradation of cleaning performance.

As a technique for improving the cleaning performance, Japanese Patent Application Laid-Open No. 2010-26240 discloses an electrophotographic photosensitive member having a specific concave portion on a surface thereof.

Japanese Patent Application Laid-Open No. 2010-250355 discloses a toner image carrier having a specific concave portion on an outer peripheral surface thereof.

Even when the techniques disclosed in Japanese Patent Application Laid-Open No. 2010-26240 and Japanese Patent Application Laid-Open No. 2010-250355 are employed, however, although the cleaning performance can be improved, there still remains room for improvement because a streak-like image defect (hereinafter also referred to as the "H/H initial streak (high temperature/high humidity environmental initial streak)") is caused on a halftone image having a density of about 30% output after printing in a low printing mode is performed under a high-temperature and high-humidity environment.

SUMMARY OF THE INVENTION

The present invention is directed to providing an electrophotographic photosensitive member capable of reducing a streak-like image defect caused in output in a low printing mode performed under a high-temperature and high-humidity environment, and a process cartridge and an electrophotographic apparatus including the electrophotographic photosensitive member.

According to one aspect of the present invention, there is provided an electrophotographic photosensitive member having a convex portion and a concave portion on a surface of the electrophotographic photosensitive member continuously in a peripheral direction of the electrophotographic photosensitive member, and alternately in an axial direction of the electrophotographic photosensitive member, in which a width w of the concave portion is 30 μm or more and 100 μm or less, a depth d of the concave portion is 1 μm or more and 5 μm or less, the convex portion has a rising slope and a descending slope in the peripheral direction of the electrophotographic photosensitive member, and a distance from a starting point of the rising slope to an end point of the descending slope is 300 μm or less, and a distance from a starting point of the descending slope to an end point of the rising slope is 300 μm or less.

According to another aspect of the present invention, there is provided an electrophotographic photosensitive member having a convex portion and a concave portion a surface of the electrophotographic photosensitive member continuously in a peripheral direction of the electrophotographic photosensitive member, and alternately in an axial direction of the electrophotographic photosensitive member, in which the convex portion has a rising slope and a descending slope in the peripheral direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

According to further aspect of the present invention, there is provided a process cartridge including at least an electrophotographic photosensitive member having a photosensitive layer on a cylindrical support; and a cleaning blade, in which a surface of the electrophotographic photosensitive member has a convex portion and a concave portion continuously in a peripheral direction of the electrophotographic photosensitive member, and alternately in an axial direction of the electrophotographic photosensitive member, a width w of the concave portion is 30 μm or more and 100 μm or less, a depth d of the concave portion is 1 μm or more and 5 μm or less, the convex portion has a rising slope and a descending slope in a rotating direction of the electrophotographic photosensitive member, and a distance from a starting point of the rising slope to an end point of the descending slope is 300 μm or less, and a distance from a starting point of the descending slope to an end point of the rising slope is 300 μm or less.

According to further aspect of the present invention, there is provided a process cartridge including at least an electrophotographic photosensitive member having a photosensitive layer on a cylindrical support; and a cleaning blade, in which a surface of the electrophotographic photosensitive member has a convex portion and a concave portion continuously in a peripheral direction of the electrophotographic photosensitive member, and alternately in an axial direction of the electrophotographic photosensitive member, the convex portion has a rising slope and a descending slope in a rotating direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

According to further aspect of the present invention, there is provided an electrophotographic apparatus including: a process cartridge at least including an electrophotographic photosensitive member having a photosensitive layer on a cylindrical support, and a cleaning blade; a charging unit; an exposing unit; a developing unit; and a transfer unit, in which a surface of the electrophotographic photosensitive member has a convex portion and a concave portion continuously in a peripheral direction of the electrophotographic photosensitive member, and alternately in an axial direction of the electrophotographic photosensitive member, a width w of the concave portion is 30 μm or more and 100 μm or less, a depth d of the concave portion is 1 μm or more and 5 μm or less, the convex portion has a rising slope and a descending slope in a rotating direction of the electrophotographic photosensitive member, and a distance from a starting point of the rising slope to an end point of the descending slope is 300 μm or less, and a distance from a starting point of the descending slope to an end point of the rising slope is 300 μm or less.

According to further aspect of the present invention, there is provided an electrophotographic apparatus including: a process cartridge at least including an electrophotographic photosensitive member having a photosensitive layer on a cylindrical support, and a cleaning blade; a charging unit; an exposing unit; a developing unit; and a transfer unit, in which a surface of the electrophotographic photosensitive member has a convex portion and a concave portion continuously in a peripheral direction of the electrophotographic photosensitive member, and alternately in an axial direction of the electrophotographic photosensitive member, the convex portion has a rising slope and a descending slope in the rotating direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

According to the present invention, an electrophotographic photosensitive member capable of reducing a streak-like image defect caused in output in a low printing mode performed under a high-temperature and high-humidity environment, and a process cartridge and an electrophotographic apparatus including the electrophotographic photosensitive member can be provided.

Further features of the present invention will become apparent from the following description of exemplary embodiments with reference to the attached drawings.

DESCRIPTION OF THE EMBODIMENTS

Figure 1:
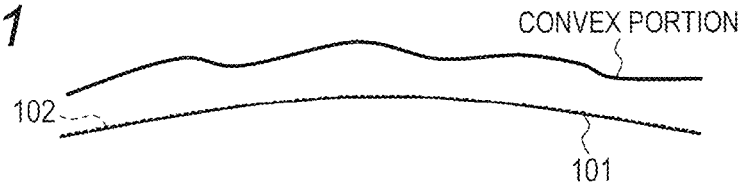
FIG. 1 is a diagram illustrating an example of fitting.

Preferred embodiments of the present invention will now be described in detail in accordance with the accompanying drawings.

The present invention has a feature, as compared with the techniques of Japanese Patent Application Laid-Open No. 2010-26240 and Japanese Patent Application Laid-Open No. 2010-250355, that a convex portion formed on a surface of an electrophotographic photosensitive member has a rising slope and a descending slope within a specific distance when a concave portion formed on the surface of the electrophotographic photosensitive member has a width and a depth within prescribed ranges. As another feature of the present invention, a convex portion formed on a surface of an electrophotographic photosensitive member has a rising slope and a descending slope within a specific distance, and at least one of rising slopes of convex portions adjacent to each other is shifted by a prescribed or larger distance in an axial direction of the electrophotographic photosensitive member.

As a result of examinations made by the present inventors, it was revealed that an effect of inhibiting occurrence of a streak-like image defect under a high-temperature and high-humidity environment is remarkably improved by providing the concave portion and the convex portion described above on the surface of the electrophotographic photosensitive member.

The present inventors presume that this effect is obtained for the following reason: When the concave portion formed on the surface of the electrophotographic photosensitive member has a width and a depth within the prescribed ranges, a cleaning blade follows also the concave portion but a contact pressure against the concave portion is reduced. As a result, an average friction coefficient is reduced, and hence, the cleaning blade is inhibited from largely twisting in the lengthwise direction or vibrating (chattering). Besides, when the convex portion formed on the surface of the electrophotographic photosensitive member has the rising slope and the descending slope within the specific distance, a contact pressure against the convex portion is inhibited from being always kept to be high. As a result, deformation of the cleaning blade otherwise caused by the convex portion, and vibration of the cleaning blade resulting from the deformation can be inhibited, and hence, the behavior of the cleaning blade in a micro region can be made further even. In this manner, evenness in a rubbing state between the cleaning blade and the electrophotographic photosensitive member can be remarkably improved, and therefore, occurrence of image memory otherwise caused by a substance adhering onto the electrophotographic photosensitive member or by unevenness in the rubbing state is inhibited, resulting in exhibiting the effect of inhibiting the occurrence of the H/H initial streak.

Besides, the present inventors presume that the aforementioned effect is obtained also for the following reason: The convex portion formed on the surface of the electrophotographic photosensitive member has the rising slope and the descending slope within the specific distance, and at least one of the rising slopes of the convex portions adjacent to each other is shifted by a prescribed or larger distance in the axial direction of the electrophotographic photosensitive member. Therefore, timing of the cleaning blade passing through the rising slope of the convex portion, when a load to the cleaning blade is increased, is dispersed. As a result, the deformation of the cleaning blade otherwise caused in passing through the rising slope and the vibration of the cleaning blade caused due to the deformation are inhibited, and hence, the behavior of the cleaning blade in a micro region can be made further even. In this manner, the evenness in the rubbing state between the cleaning blade and the electrophotographic photosensitive member can be remarkably improved, and therefore, the occurrence of image memory otherwise caused by a substance adhering onto the electrophotographic photosensitive member or by the unevenness in the rubbing state is inhibited, resulting in exhibiting the effect of inhibiting the occurrence of the H/H initial streak.

Specifically, on a surface of the electrophotographic photosensitive member of the present invention, a convex portion and a concave portion continuous in the peripheral direction are alternately provided in the axial direction of the electrophotographic photosensitive member. A width w (μm) of the concave portion is 30 μm or more and 100 μm or less, a depth d (μm) of the concave portion is 1 μm or more and 5 μm or less, the convex portion has a rising slope and a descending slope in the peripheral direction of the electrophotographic photosensitive member, a distance from a starting point of the rising slope to an end point of the descending slope is 300 μm or less, and a distance from a starting point of the descending slope to an end point of the rising slope is 300 μm or less.

Alternative on a surface of the electrophotographic photosensitive member of the present invention, a convex portion and a concave portion continuous in the peripheral direction are alternately provided in the axial direction of the electrophotographic photosensitive member. The convex portion has a rising slope and a descending slope in the peripheral direction of the electrophotographic photosensitive member, a distance from a starting point of the rising slope to an end point of the descending slope is 300 μm or less, and a distance from a starting point of the descending slope to an end point of the rising slope is 300 μm or less. At least one of rising slopes of convex portions adjacent to each other is shifted by 20 μm or more in the axial direction of the electrophotographic photosensitive member.

The concave portion and the convex portion provided on the surface of the electrophotographic photosensitive member can be observed with a microscope, such as a laser microscope, an optical microscope, an electron microscope or an atomic force microscope.

Examples of the laser microscope usable here include the following:

Super-depth shape measuring microscopes VK-8550, VK-9000, VK-9500 and VK-X200 manufactured by Keyence Corporation; a surface shape measuring system Surface Explorer SX-520DR manufactured by Ryoka Systems Inc.; a confocal scanning laser microscope OLS3000 manufactured by Olympus Corporation; and a real color confocal microscope OPTELICS C130 manufactured by Lasertec Corporation.

Examples of the optical microscope usable here include the following:

Digital microscopes VHX-500 and VHX-200 manufactured by Keyence Corporation; and a 3D digital microscope VC-7700 manufactured by Omron Corporation.

Examples of the electron microscope usable here include the following:

3D Real Surface View Microscope VE-9800 and 3D Real Surface View Microscope VE-8800 manufactured by Keyence Corporation; a scanning electron microscope Conventional/Variable Pressure SEM manufactured by SII Nanotechnology Inc.; and a scanning electron microscope SUPERSCAN SS-550 manufactured by Shimadzu Corporation.

Examples of the atomic force microscope usable here include the following:

A nanoscale hybrid microscope VN-8000 manufactured by Keyence Corporation; a scanning probe microscope Nano Navi Station manufactured by SII Nanotechnology Inc.; and a scanning probe microscope SPM-9600 manufactured by Shimadzu Corporation.

Now, the concave portion and the convex portion of the present invention will be described in detail.

First, the surface of the electrophotographic photosensitive member is magnification observed with a microscope. If the surface (peripheral surface) of the electrophotographic photosensitive member is a surface curved in the peripheral direction as in, for example, a cylindrical electrophotographic photosensitive member, a cross-sectional profile of the curved surface is extracted to be fitted to a curve (that is, an arc if the electrophotographic photosensitive member is in a cylindrical shape). FIG. 1 illustrates an example of the fitting. In the example illustrated in FIG. 1, the electrophotographic photosensitive member is in a cylindrical shape. In FIG. 1, a solid line 101 denotes a cross-sectional profile of the surface (curved surface) of the electrophotographic photosensitive member, and a broken line 102 denotes a curve fitted to the cross-sectional profile 101. The cross-sectional profile 101 is corrected so as to change the curve 102 to a straight line, and a plane obtained by expanding the thus obtained straight line in a lengthwise direction (i.e., a direction perpendicular to the peripheral direction) of the electrophotographic photosensitive member is set as a reference plane. Also when the electrophotographic photosensitive member is not in a cylindrical shape, a reference plane is obtained in the same manner as in the case where the electrophotographic photosensitive member is in a cylindrical shape.

A portion above the thus obtained reference plane in a square region with a side of 500 μm on the reference plane is defined as the convex portion. A distance from the reference plane up to an uppermost point of the convex portion is defined as the height of the convex portion.

Figure 2A:
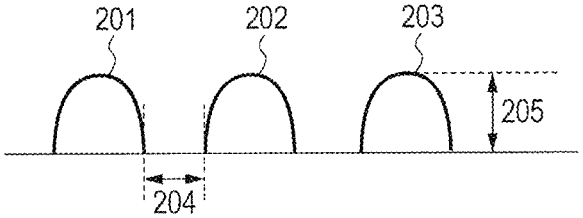
FIGS. 2A, 2B and 2C are cross-sectional views schematically illustrating the relationship between a concave portion and a convex portion provided on a surface of an electrophotographic photosensitive member.
Figure 2B:
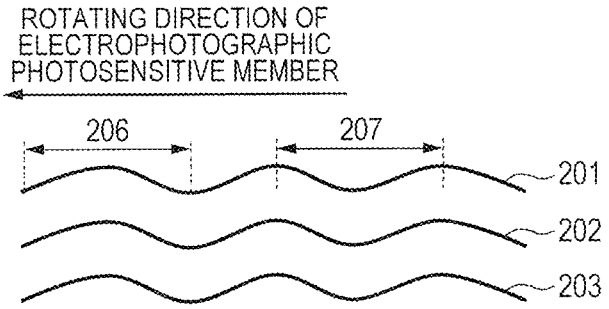
Figure 2C:
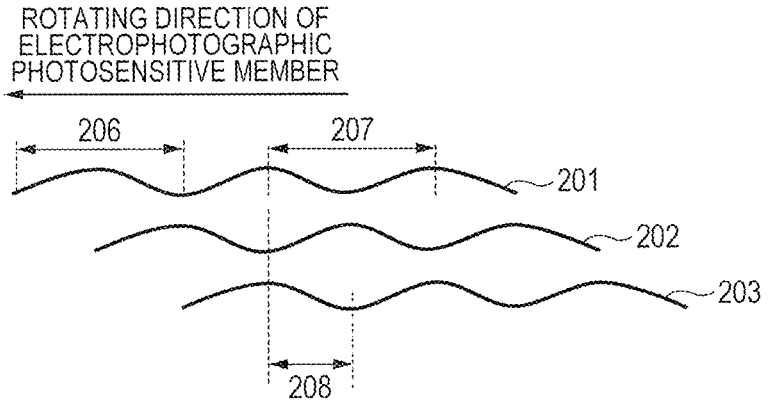
Figure 3A:
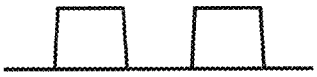
FIGS. 3A, 3B, 3C, 3D, 3E and 3F are diagrams illustrating examples of a cross-sectional shape in an axial direction of the convex portion provided on the surface of the electrophotographic photosensitive member.
Figure 3B:
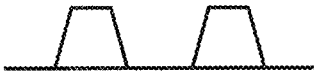
Figure 3C:
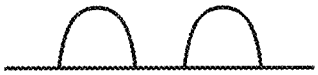
Figure 3D:
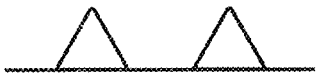
Figure 3E:
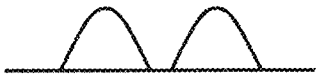
Figure 3F:
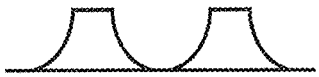
Figure 4A:
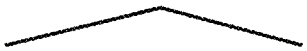
FIGS. 4A, 4B, 4C, 4D, 4E, 4F, 4G and 4H are diagrams illustrating examples of the cross-sectional shape in a peripheral direction of the convex portion provided on the surface of the electrophotographic photosensitive member.
Figure 4B:
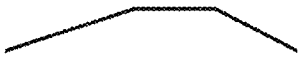
Figure 4C:
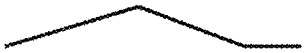
Figure 4D:
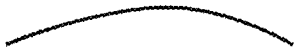
Figure 4E:
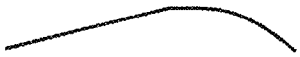
Figure 4F:
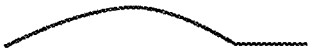
Figure 4G:
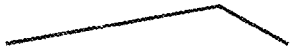
Figure 4H:
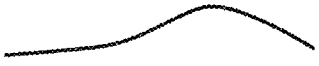

An example of the cross-section taken in the axial direction of the concave portion and the convex portion of the electrophotographic photosensitive member is illustrated in FIG. 2A, and examples of the cross-section taken in the peripheral direction thereof are illustrated in FIGS. 2B and 2C. The examples of the cross-sections of the concave portion and the convex portion in the peripheral direction illustrated in FIGS. 2A, 2B and 2C are cross-sectional profiles resulting from the correction. Examples of the cross-sectional shape in the axial direction of the concave portion and the convex portion are illustrated in FIGS. 3A to 3F. It is noted that the peripheral direction of the electrophotographic photosensitive member means a rotating direction of the electrophotographic photosensitive member if the electrophotographic photosensitive member is assembled in a process cartridge or an electrophotographic apparatus including the process cartridge.

Examples of the cross-sectional shape in the peripheral direction of the convex portion are illustrated in FIGS. 4A to 4H.

The examples of the concave portion and the convex portion illustrated in FIGS. 2A, 2B and 2C will now be described. First, the cross-sectional shape in the axial direction of the concave portion and the convex portion will be described. In the exemplified cross-section in the axial direction of the concave portion and the convex portion illustrated in FIG. 2A, adjacent convex portions 201, 202 and 203 are alternately disposed with concave portions each having a width 204 and a depth 205.

In the present invention, the width 204 can be 30 μm or more and 100 μm or less from the viewpoint of reduction of the H/H initial streak. Besides, the depth 205 can be 1 μm or more and 5 μm or less from the viewpoint of the reduction of the H/H initial streak.

Next, the cross-section taken in the peripheral direction of the convex portion will be described. In the cross-section taken in the peripheral direction of the convex portion illustrated in FIG. 2B, each of the adjacent convex portions 201, 202 and 203 has a rising slope and a descending slope in the rotating direction of the electrophotographic photosensitive member. Besides, the rising slopes of the adjacent convex portions 201, 202 and 203 accord with one another in the axial direction.

In the present invention, if the width of the concave portion is 30 μm or more and 100 μm or less and the depth thereof is 1 μm or more and 5 μm or less, the shapes of the rising slopes of the adjacent convex portions may accord with one another in the axial direction as illustrated in FIG. 2B.

Besides, a distance 206 from a starting point of the rising slope to an end point of the descending slope can be 300 μm or less from the viewpoint of the reduction of the H/H initial streak. Furthermore, a distance 207 from a starting point of the descending slope to an end point of the rising slope can be 300 μm or less from the viewpoint of the reduction of the H/H initial streak.

Moreover, in the present invention, a maximum rising slope in the rising slope can fall in a prescribed range from the viewpoint of the reduction of the H/H initial streak because the cleaning blade can be thus more stabilized. The maximum rising slope of the present invention can be obtained, for example, based on a height difference between the starting point and the end point of the rising slope of the convex portion, and a moving distance of the electrophotographic photosensitive member from the starting point to the end point of the rising slope. Specifically, if the electrophotographic photosensitive member has a constant slope, the maximum rising slope corresponds to "(height of end point of rising slope—height of starting point of rising slope)/moving distance". It is noted that the height of the starting point of the rising slope corresponds to a minimum distance between the starting point of the rising slope of the convex portion and the reference plane. If the rising slope is constituted by a curve, the rising slope is divided into five sections in a direction vertical to the axial direction, slopes of the divided sections are obtained, and a maximum value of the slopes is defined as the maximum rising slope. In the present invention, the maximum rising slope of the convex portion is preferably 70 permil (‰) or less, and more preferably 50 permil or less from the viewpoint of the reduction of the H/H initial streak. Besides, the maximum rising slope can be 10 permil or more.

Next, another example of the cross-sectional shape in the peripheral direction of the convex portion will be described. In the cross-section taken in the peripheral direction of the convex portion illustrated in FIG. 2C, the adjacent convex portions 201, 202 and 203 have rising slopes and descending slops along the rotating direction of the electrophotographic photosensitive member. Besides, the rising slopes of the adjacent convex portions 201, 202 and 203 are disposed to be shifted in the axial direction of the electrophotographic photosensitive member by a distance 208.

In the present invention, at least one of the rising slopes of the convex portions adjacent to each other can be shifted in the axial direction by 20 μm or more from the viewpoint of the reduction of the H/H initial streak. Besides, all the rising slopes of the convex portions adjacent to one another are more preferably shifted in the axial direction by 20 μm or more.

Examples of the cross-sectional shapes in the axial direction of the concave and convex portions of the present invention include shapes illustrated in FIGS. 3A to 3F. Besides, examples of the cross-sectional shapes in the peripheral direction of the convex portion include shapes illustrated in FIGS. 4A to 4H.

A plurality of concave portions and convex portions provided on the surface of the electrophotographic photosensitive member all may have the same shape, width, depth and slope, or some of these may have different shapes, widths, depths or slopes. Alternatively, a concave portion and a convex portion having a shape, a width, a depth and a slope different from those of the present invention may be provided if necessary.

The concave portion and the convex portion may be formed entirely on the surface of the electrophotographic photosensitive member, or may be formed partly on the surface of the electrophotographic photosensitive member. If the concave portion and the convex portion are formed partly on the surface of the electrophotographic photosensitive member, the concave portion and the convex portion are preferably formed at least in a whole region brought into contact with the cleaning blade.

<Method for Forming Concave Portion and Convex Portion on Surface of Electrophotographic Photosensitive Member>

A mold having a convex and a concave corresponding to the concave portion and the convex portion to be formed is pressed against the surface of the electrophotographic photosensitive member, so as to transfer shapes of the convex and the concave, and thus, the concave portion and the convex portion can be formed on the surface of the electrophotographic photosensitive member.

Figure 5:
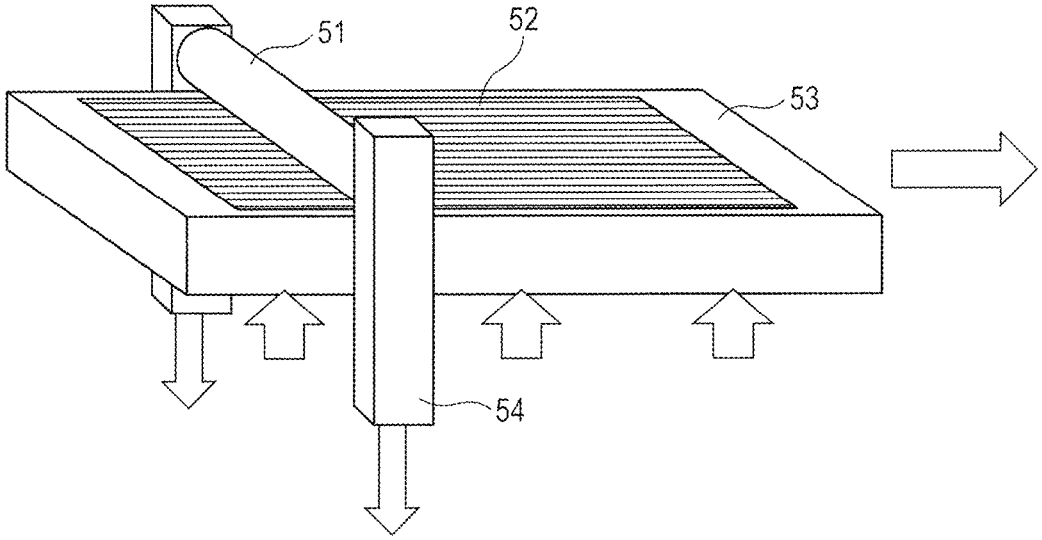
FIG. 5 is a diagram illustrating an example of a pressure shape transferring apparatus used for forming the concave portion and the convex portion on the surface of the electrophotographic photosensitive member.

FIG. 5 illustrates an example of a pressure shape transferring apparatus used for forming the concave portion and the convex portion the surface of the electrophotographic photosensitive member.

In the pressure shape transferring apparatus of FIG. 5, while rotating an electrophotographic photosensitive member 51 to be machined, a mold 52 is continuously brought into contact with and pressed against the surface (peripheral surface) of the electrophotographic photosensitive member 51, and thus, the concave portion and the convex portion can be formed on the surface of the electrophotographic photosensitive member 51.

A pressing member 53 is made of, for example, a metal, a metal oxide, a plastic or glass. Among these materials, stainless steel (SUS) is preferably used from the viewpoint of mechanical strength, dimensional accuracy and durability. On an upper surface of the pressing member 53, the mold 52 is disposed. Besides, owing to a supporting member (not illustrated) and a pressure system (not illustrated) disposed on a lower surface side, the pressing member 53 can press the mold 52, with a prescribed pressure, against the surface of the electrophotographic photosensitive member 51 supported on a supporting member 54. Alternatively, the supporting member 54 may be pressed against the pressing member 53 with a prescribed pressure, or the supporting member 54 and the pressing member 53 may be pressed against each other.

In the exemplified apparatus illustrated in FIG. 5, the pressing member 53 is moved in a direction vertical to the axial direction of the electrophotographic photosensitive member 51, so as to continuously machine the surface of the electrophotographic photosensitive member 51 during driven or driving rotation of the electrophotographic photosensitive member 51. Alternatively, the surface of the electrophotographic photosensitive member 51 may be continuously machined by moving the supporting member 54 in the direction vertical to the axial direction of the electrophotographic photosensitive member 51 with the pressing member 53 fixed, or by moving both the supporting member 54 and the pressing member 53.

In order to efficiently perform the shape transfer, the mold 52 and the electrophotographic photosensitive member 51 can be heated to a temperature of 100° C. or more.

The mold 52 is made of, for example, a metal or a resin film having a surface finely finished, a silicon wafer or the like having a surface patterned with a resist, a resin film having a fine particle dispersed thereon, or a resin film having a fine surface shape and coated with a metal.

Furthermore, in order to make even the pressure against the electrophotographic photosensitive member 51, an elastic member can be disposed between the mold 52 and the pressing member 53.

<Structure of Electrophotographic Photosensitive Member>

The electrophotographic photosensitive member of the present invention includes a support and a photosensitive layer formed on the support.

The electrophotographic photosensitive member is in the shape of, for example, a cylinder, a belt (an endless belt) or a sheet.

The photosensitive layer may be a single-layered photosensitive layer containing a charge transport material and a charge generation material in the same layer, or may be a multilayered (function-separated) photosensitive layer dividedly including a charge generation layer containing a charge generation material and a charge transport layer containing a charge transport material. From the viewpoint of electrophotographic characteristics, the multilayered photosensitive layer is preferably used. Besides, the multilayered photosensitive layer may be a normal layer type photosensitive layer including a charge generation layer and a charge transport layer stacked in this order on the support, or a reverse layer type photosensitive layer including a charge transport layer and a charge generation layer stacked in this order on the support. From the viewpoint of the electrophotographic characteristics, the normal layer type photosensitive layer is preferably used. Furthermore, the charge generation layer may have a multilayered structure, or the charge transport layer may have a multilayered structure.

The support used in the electrophotographic photosensitive member of the present invention can be a support having conductivity (conductive support). Examples of a material of the support include metals (alloys) such as iron, copper, gold, silver, aluminum, zinc, titanium, lead, nickel, tin, antimony, indium, chromium, an aluminum alloy, and stainless steel. Alternatively, a metal support or a plastic support having a coating film formed by vacuum evaporation using aluminum, an aluminum alloy, an indium oxide-tin oxide alloy, or the like can be used. Alternatively, a support obtained by impregnating a plastic or paper with a conductive particle such as carbon black, a tin oxide particle, a titanium oxide particle or a silver particle, or a support made of a conductive binder resin can be used.

For the purpose of inhibiting interference fringes caused by scattering of laser light, the surface of the support may be subjected to a cutting treatment, a surface roughening treatment, a treatment with alumite, or the like.

Between the support and an undercoat layer described later or the photosensitive layer (including the charge generation layer and the charge transport layer), a conductive layer may be provided for the purpose of inhibiting interference fringes caused by scattering of laser light and covering damage of the support.

The conductive layer used in the electrophotographic photosensitive member of the present invention can be formed by applying a conductive layer coating liquid obtained by dispersing carbon black, a conductive pigment, a resistance adjusting pigment or the like together with a binder resin, and drying the resultant coated film. Besides, the conductive layer coating liquid may contain a compound cured/polymerized by heating, UV irradiation, radiation exposure or the like. The conductive layer obtained by dispersing a conductive pigment, a resistance adjusting pigment or the like tends to have a roughened surface.

The thickness of the conductive layer is preferably 0.2 μm or more and 40 μm or less, more preferably 1 μm or more and 35 μm or less, and further preferably 5 μm or more and 30 μm or less.

Examples of the binder resin used in the conductive layer include polymers of vinyl compounds such as styrene, vinyl acetate, vinyl chloride, an acrylic acid ester, a methacrylic acid ester, vinylidene fluoride and trifluoroethylene, polyvinyl alcohol, polyvinyl acetal, polycarbonate, polyester, polysulfone, polyphenylene oxide, polyurethane, a cellulose resin, a phenol resin, a melamine resin, a silicone resin, and an epoxy resin.

Examples of the conductive pigment and the resistance adjusting pigment include a particle of a metal (an alloy) such as aluminum, zinc, copper, chromium, nickel, silver or stainless steel, and a plastic particle on which any of these is vapor deposited. Alternatively, a particle of a metal oxide such as zinc oxide, titanium oxide, tin oxide, antimony oxide, indium oxide, bismuth oxide, tin-doped indium oxide, or antimony- or tantalum-doped tin oxide can be used. One of these may be singly used, or two or more of these may be used in combination. If two or more of these are used in combination, these particles may be simply mixed or may be formed into a solid solution or a fused substance.

Between the support or the conductive layer and the photosensitive layer (including the charge generation layer and the charge transport layer), an undercoat layer (an intermediate layer) having a barrier function or an adhesion function may be provided for the purpose of improving adhesiveness or coating properties of the photosensitive layer, improving charge injection properties from the support, protecting the photosensitive layer from electrical breakdown, or the like.

The undercoat layer can be formed by applying an undercoat layer coating liquid obtained by dissolving a resin (a binder resin) in a solvent, and drying the resultant coated film.

Examples of the resin usable in the undercoat layer include polyvinyl alcohol, poly-N-vinylimidazole, polyethylene oxide, ethyl cellulose, an ethylene-acrylic acid copolymer, casein, polyamide, N-methoxymethylated nylon 6, copolymerized nylon, glue, gelatin, a polyurethane resin, an acrylic resin, an allyl resin, an alkyd resin, a phenol resin and an epoxy resin.

The undercoat layer may contain a metal oxide particle. Examples of a metal oxide in the form of a particle used in the undercoat layer include titanium oxide, zinc oxide, tin oxide, zirconium oxide and aluminum oxide.

The metal oxide particle may be a particle of a metal oxide, a surface of which has been treated with a surface treatment agent such as a silane coupling agent.

For dispersing the metal oxide particle, a method using a homogenizer, an ultrasonic disperser, a ball mill, a sand mill, a roll mill, a vibration mill, an attritor, or a liquid collision type high-speed disperser may be employed.

The undercoat layer may further contain an organic resin particle or a leveling agent for the purpose of adjusting the surface roughness of the undercoat layer or reducing occurrence of crack in the undercoat layer. As the organic resin particle, a hydrophobic organic resin particle such as a silicone particle, or a hydrophilic organic resin particle such as a cross-linked polymethacrylate resin (PMMA) particle can be used.

The thickness of the undercoat layer is preferably 0.05 μm or more and 40 μm or less, and more preferably 0.2 μm or more and 35 μm or less.

Examples of the charge generation material used in the photosensitive layer include pyrylium or thiopyrylium dyes, phthalocyanine pigments containing various central metals or having various crystal forms (of, for example, α, β, γ, ϵ and X), anthanthrone pigments, dibenzpyrenequinone pigments, pyranthrone pigments, azo pigments including monoazo, disazo and triazo pigments, indigo dyes, quinacridone pigments, asymmetric quinocyanine pigments and quinocyanine pigments. One of these charge generation materials may be singly used, or two or more of these may be used together.

Examples of the charge transport material used in the photosensitive layer include pyrene compounds, N-alkylcarbazole compounds, hydrazone compounds, N,N-diakylaniline compounds, diphenylamine compounds, triphenylamine compounds, triphenylmethane compounds, pyrazoline compounds, styryl compounds and stylbene compounds.

If the photosensitive layer is a multilayered photosensitive layer, the charge generation layer can be formed by applying a charge generation layer coating liquid that is obtained by dispersing a charge generation material and a binder resin in a solvent, and drying the resultant coated film. Alternatively, the charge generation layer may be formed as a vapor-deposited film of a charge generation material.

A mass ratio between the charge generation material and the binder resin can fall in a range from 1:0.3 to 1:4.

The dispersion is performed by using, for example, a homogenizer, an ultrasonic disperser, a ball mill, a vibration ball mill, a sand mill, an attritor, a roll mill or the like.

The charge transport layer can be formed by applying a charge transport layer coating liquid that is obtained by dissolving a charge transport material and a binder resin in a solvent, and drying the resultant coated film. If a charge transport material having a film forming property by itself is used, the charge transport layer can be formed without using a binder resin.

Examples of the binder resin used in the charge generation layer and the charge transport layer include polymers of vinyl compounds such as styrene, vinyl acetate, vinyl chloride, an acrylic acid ester, a methacrylic acid ester, vinylidene fluoride and trifluoroethylene, polyvinyl alcohol, polyvinyl acetal, polycarbonate, polyester, polysulfone, polyphenylene oxide, polyurethane, a cellulose resin, a phenol resin, a melamine resin, a silicone resin, and an epoxy resin.

The thickness of the charge generation layer is preferably 5 μm or less, and more preferably 0.1 to 2 μm.

The thickness of the charge transport layer is preferably 5 to 50 μm, and more preferably 10 to 35 μm.

Besides, from the viewpoint of improving the durability of the electrophotographic photosensitive member, a surface layer of the electrophotographic photosensitive member can be made of a cross-linked organic polymer.

In the present invention, for example, the charge transport layer provided on the charge generation layer can be made of a cross-linked organic polymer as the surface layer of the electrophotographic photosensitive member. Alternatively, a surface layer made of a cross-linked organic polymer can be formed as a second charge transport layer or a protection layer on the charge transport layer provided on the charge generation layer. Besides, the surface layer made of a cross-linked organic polymer is required to have a feature that film strength and charge transportability are both achieved, and from this point of view, the surface layer can be formed by using a charge transport material or a conductive particle and a cross-linking polymerizable monomer/oligomer.

As the charge transport material, any of the above-described charge transport materials can be used. Besides, as the conductive particle, any of known conductive particles can be used. Examples of the cross-linking polymerizable monomer/oligomer include a compound having a chain polymerizable functional group such as an acryloyloxy group or a styryl group, and a compound having a sequentially polymerizable functional group such as a hydroxyl group, an alkoxysilyl group or an isocyanate group.

Besides, from the viewpoint of achieving both the film strength and the charge transportability, a compound having, in one molecule, both a charge transport structure (preferably, a hole transport structure) and an acryloyloxy group is more preferably used.

As a cross-linking and curing method, for example, a method using heat, ultraviolet or radiation is employed.

The thickness of the surface layer made of the cross-linked organic polymer is preferably 0.1 to 30 μm, and more preferably 1 to 10 μm.

Each layer included in the electrophotographic photosensitive member can contain an additive. Examples of the additive include deterioration inhibitors such as an antioxidant and a UV absorber, organic resin particles such as a fluorine atom-containing resin particle and an acrylic resin particle, and inorganic particles of silica, titanium oxide and alumina.

<Structures of Process Cartridge and Electrophotographic Apparatus>

Figure 6:
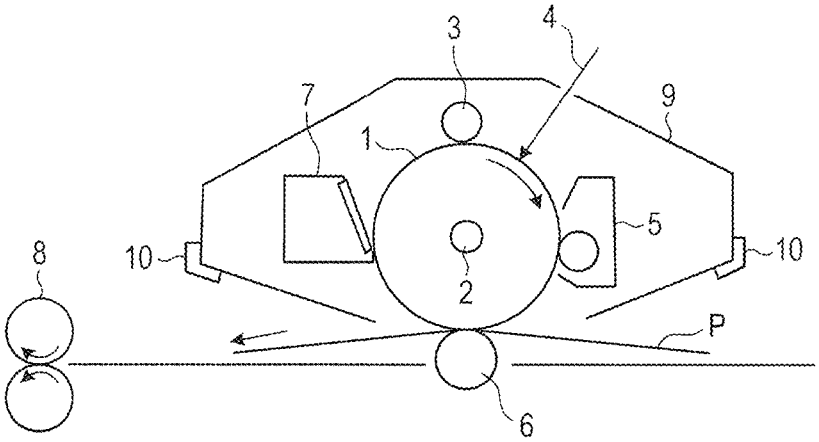
FIG. 6 is a diagram illustrating an example of an electrophotographic apparatus equipped with a process cartridge including an electrophotographic photosensitive member of the present invention.

FIG. 6 illustrates an example of an electrophotographic apparatus equipped with a process cartridge including the electrophotographic photosensitive member of the present invention.

In FIG. 6, the electrophotographic photosensitive member 1 in a cylindrical shape according to the present invention is driven to rotate around a shaft 2 in an arrow direction at a prescribed peripheral speed (process speed). The surface of the electrophotographic photosensitive member 1 is evenly charged to a positive or negative prescribed potential by a charging unit 3 (a primary charging unit: such as a charging roller) in the rotation process. Subsequently, the evenly charged surface of the electrophotographic photosensitive member 1 is irradiated with exposure light (image exposure light) 4 emitted from an exposing unit (an image exposing unit) (not illustrated). In this manner, an electrostatic latent image corresponding to desired image information is formed on the surface of the electrophotographic photosensitive member 1.

The present invention exhibits a great effect particularly when a charging unit utilizing discharge is used.

The electrostatic latent image formed on the surface of the electrophotographic photosensitive member 1 is subsequently developed (normally developed or reversely developed) with a toner (an amorphous toner or a spherical toner) contained in a developing unit 5 to form a toner image. The toner image formed on the surface of the electrophotographic photosensitive member 1 is transferred onto a transfer member with a transfer bias applied by a transfer unit (such as a transfer roller) 6. Here, the transfer member P is taken out and fed from a transfer member supplying unit (not illustrated) to a portion (a contact portion) between the electrophotographic photosensitive member 1 and the transfer unit 6 in synchronization with the rotation of the electrophotographic photosensitive member 1. Besides, a bias voltage having a reverse polarity to the charge of the toner is applied to the transfer unit by a bias power source (not illustrated).

The transfer member P to which the toner image has been transferred is separated from the surface of the electrophotographic photosensitive member and conveyed to a fixing unit 8 to be subjected to a fixing treatment of the toner image. Thus, the resultant transfer member is ejected out of the electrophotographic apparatus as an image formed matter (a printed or copied matter).

After transferring the toner image, the surface of the electrophotographic photosensitive member 1 is cleaned by a cleaning unit 7 having a cleaning blade provided in contact with the surface of the electrophotographic photosensitive member 1 so as to remove adhering substances such as a residual untransferred portion of the toner therefrom. Besides, the cleaned surface of the electrophotographic photosensitive member 1 is subjected to electricity removal with the exposure light (not illustrated) emitted from the exposing unit (not illustrated), so as to be repeatedly used for image formation thereafter. If the charging unit 3 is a contact charging unit using a charging roller or the like as illustrated in FIG. 6, the exposing unit is not always necessary.

In the present invention, a plurality of components selected from the group consisting of the electrophotographic photosensitive member 1, the charging unit 3, the developing unit 5, the cleaning unit 7 and the like are housed in a container to be integrally supported as a process cartridge. The process cartridge can be constituted to be attachable/detachable to/from a main body of an electrophotographic apparatus such as a copying machine or a laser beam printer. In FIG. 6, the electrophotographic photosensitive member 1, the charging unit 3, the developing unit 5 and the cleaning unit 7 are integrally supported in the form of a cartridge, so as to provide a process cartridge 9 attachable/detachable to/from the main body of the electrophotographic apparatus by using a guiding unit 10 such as a guide rail of the main body of the electrophotographic apparatus.

If the electrophotographic apparatus is a copying machine or a printer, the exposure light 4 is light reflected from or passing through an original, or light emitted through scanning with a laser beam and driving of an LED array or a liquid crystal shutter array performed according to a signal obtained by reading an original with a sensor.

EXAMPLES

The present invention will now be described in more detail with reference to specific examples. It is noted that "parts" used in these examples means "parts by mass". Besides, an electrophotographic photosensitive member is sometimes simply referred to as the "photosensitive member".

(Production Example of Photosensitive Member (1))

An aluminum cylinder having a diameter of 30 mm and a length of 357.5 mm was used as a support (a cylindrical support).

Next, 100 parts of a zinc oxide particle (having a specific surface area of 19 $m^2/g$ and a powder resistance of $4.7\times10^6\Omega\cdot cm$) used as a metal oxide and 500 parts of toluene were mixed by stirring, and to the resultant, 0.8 parts of a silane coupling agent (Compound Name: N-2-(aminoethyl)-3-aminopropylmethyldimethoxysilane, Trade Name: KBM602, manufactured by Shin-Etsu Chemical Co., Ltd.) was added, followed by stirring for 6 hours. Thereafter, toluene was distilled off under reduced pressure, the resultant was heated and dried at 130° C. for 6 hours, and thus, a surface treated zinc oxide particle was obtained.

Next, 15 parts of a butyral resin (Trade Name: BM-1, manufactured by Sekisui Chemical Co., Ltd.) used as a polyol resin and 15 parts of blocked isocyanate (Trade Name: Sumidur 3175, manufactured by Sumitomo Bayer Urethane Co., Ltd.) were dissolved in a mixed solution of 73.5 parts of methyl ethyl ketone and 73.5 parts of 1-butanol. To the resultant solution, 80.8 parts of the surface treated zinc oxide particle and 0.8 parts of 2,3,4-trihydroxybenzophenone (manufactured by Tokyo Chemical Industry Co., Ltd.) were added, and dispersed under an atmosphere of 23±3° C. for 3 hours with a sand mill using a glass bead with a diameter of 0.8 mm. After the dispersion, 0.01 parts of silicone oil (Trade Name: SH28PA, manufactured by Dow Corning Toray Silicone Co., Ltd.) and 5.6 parts of a cross-linked methyl polymethacrylate (PMMA) particle (Trade Name: TECHPOLYMER SSX-102, manufactured by Sekisui Plastics Co., Ltd., having an average primary particle size of 2.5 μm) were added thereto, the resultant was stirred, and thus, an undercoat layer coating liquid was prepared.

The support was dip-coated with this undercoat layer coating liquid, and the thus obtained coated film was dried at 160° C. for 40 minutes to form an undercoat layer with a thickness of 18 μm.

Next, 20 parts of hydroxygallium phthalocyanine crystal (a charge generation material) in a crystal form having strong peaks at 7.4° and 28.2° of Bragg angle 2θ±0.2° in CuKα characteristic X-ray diffraction analysis, 0.2 parts of a calixarene compound represented by the following structural formula (A), 10 parts of polyvinyl butyral (Trade Name: S-Lec BX-1, manufactured by Sekisui Chemical Co., Ltd.) and 600 parts of cyclohexanone were charged in a sand mill using a glass bead with a diameter of 1 mm, and dispersed for 4 hours. Thereafter, 700 parts of ethyl acetate was added to the resultant, and thus, a charge generation layer coating liquid was prepared. The charge generation layer coating liquid was dip-coated on the undercoat layer, the resultant coated film was dried at 80° C. for 15 minutes, and thus, a charge generation layer having a thickness of 0.17 μm was formed.

(A)

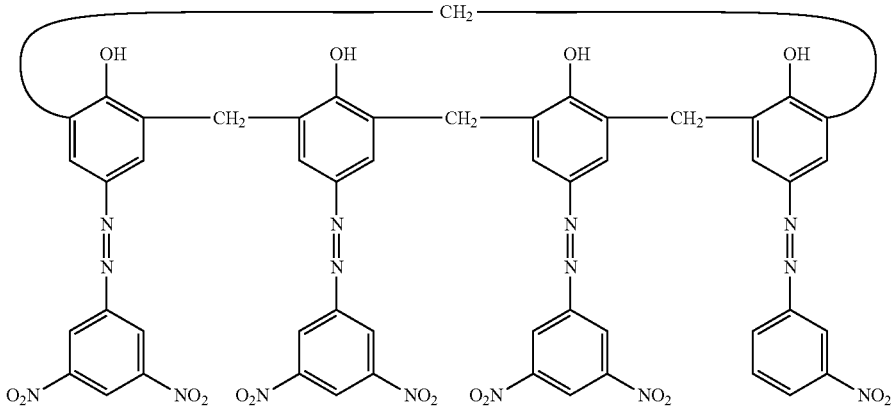

Next, 30 parts of a compound (a charge transport material) represented by the following structural formula (B), 60 parts of a compound (a charge transport material) represented by the following structural formula (C), 10 parts of a compound represented by the following structural formula (D), 100 parts of a polycarbonate resin (Trade Name: Jupilon Z400, manufactured by Mitsubishi Engineering-Plastics Corporation, bisphenol Z polycarbonate), and 0.02 parts of a polycarbonate represented by the following structural formula (E) (having a viscosity average molecular weight Mv of 20,000) were dissolved in a mixed solvent of 600 parts of mixed xylene and 200 parts of dimethoxymethane, and thus, a charge transport layer coating liquid was prepared. This charge transport layer coating liquid was dip-coated on the charge generation layer to form a coated film, the coated film was dried at 100° C. for 30 minutes, and thus, a charge transport layer having a thickness of 18 μm was formed.

(B)

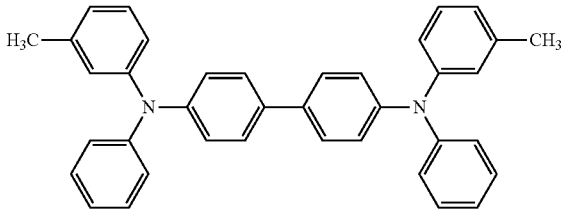

(C)

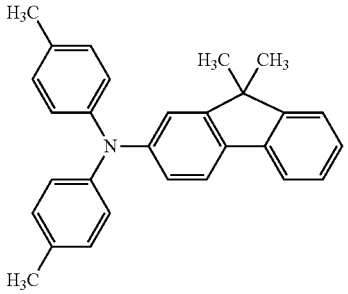

(D)

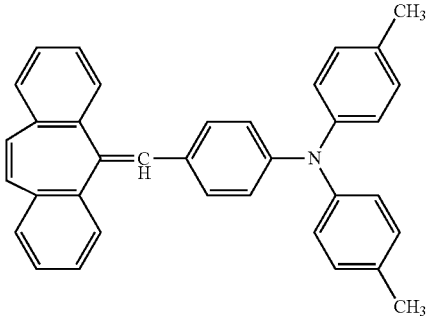

(E)

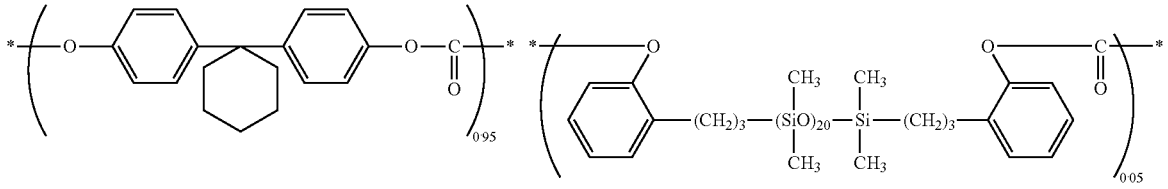

Next, 36 parts of a compound (a charge transport material having an acrylic group, that is, a chain polymerizable functional group) represented by the following structural formula (F), 4 parts of a polytetrafluoroethylene resin fine powder (Lubron L-2, manufactured by Daikin Industries, Ltd.) and 60 parts of n-propanol were dispersed and mixed using a high-pressure disperser, and thus, a protection layer coating liquid was prepared.

The protection layer coating liquid was dip-coated on the charge transport layer, and the resultant coated film was dried at 50° C. for 5 minutes. After drying, the resultant coated film was cured by irradiation with an electron beam at an acceleration voltage of 70 kV and an absorbed dose of 8,000 Gy for 1.6 seconds under a nitrogen atmosphere while rotating the cylinder. Thereafter, the resultant coated film was subjected to a heat treatment for 3 minutes under a nitrogen atmosphere and under a condition where the coated film was at 120° C. It is noted that an oxygen concentration was set to 20 ppm from the irradiation with an electron beam until the heat treatment performed for 3 minutes. Then, a heat treatment was performed for 30 minutes in the air under a condition where the coated film was at 100° C., and thus, a protection layer (a second charge transport layer) having a thickness of 5 μm was formed.

(F)

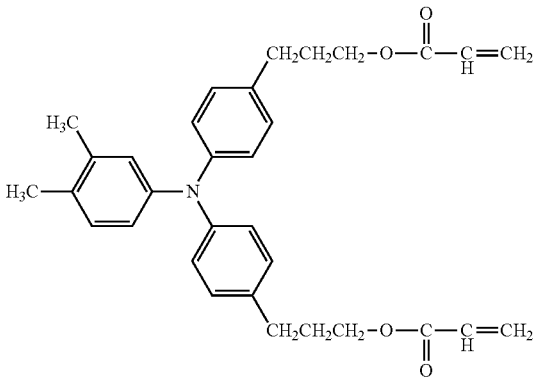

In this manner, a cylindrical electrophotographic photosensitive member before forming a concave portion and a convex portion thereon (namely, an electrophotographic photosensitive member prior to formation of a concave portion and a convex portion) was produced.

Figure 7:
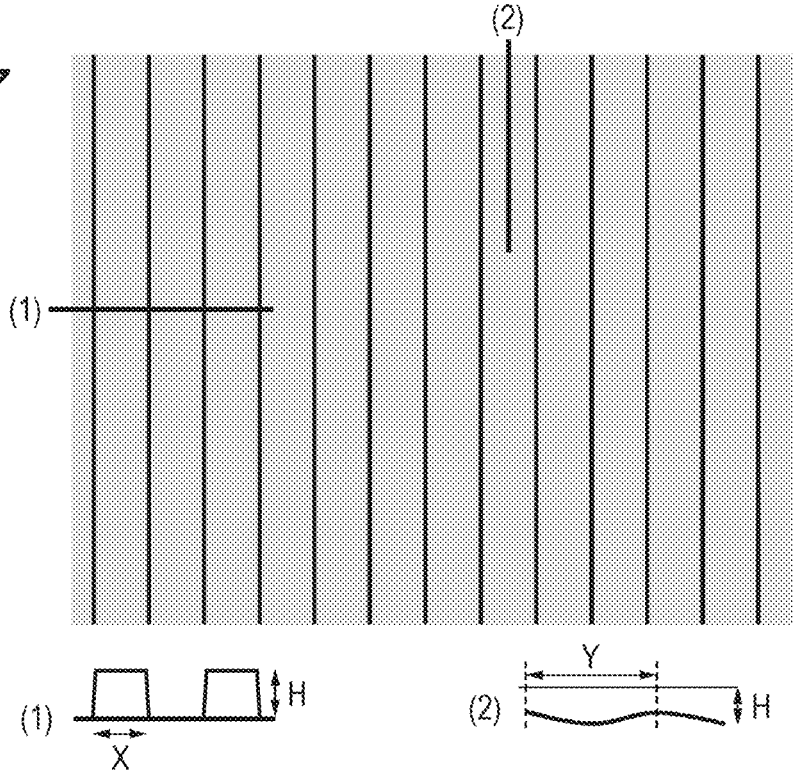
FIG. 7 is a diagram illustrating an example of a mold used in a production example of the electrophotographic photosensitive member.

Formation of Concave Portion and Convex Portion by Shape Transfer under Mold Pressure In a pressure shape transferring apparatus having substantially the same structure as that illustrated in FIG. 5, a mold having substantially the same shape as that illustrated in FIG. 7 (specifically, a mold including a convex and a concave having a convex width X of 40 μm, a concave width of 40 μm, a distance Y from a starting point of a descending slope to an end point of a rising slope of 80 μm, a distance from a starting point of the rising slope to an end point of the descending slope of 80 μm, and a height H of 2 to 6 μm as shown in Table 1) was placed as a mold, so as to mold the surface of the electrophotographic photosensitive member prior to formation of a concave portion and a convex portion produced as described above. During the molding, the temperatures of the electrophotographic photosensitive member and the mold were controlled so as to set the temperature of the surface of the electrophotographic photosensitive member at 120° C., and with the electrophotographic photosensitive member and a pressing member pressed against the mold at a pressure of 7.0 MPa, the electrophotographic photosensitive member was rotated in the peripheral direction, so as to form a concave portion and a convex portion on the whole surface (peripheral surface) of the electrophotographic photosensitive member.

In this manner, the electrophotographic photosensitive member having the concave portion and the convex portion on the surface thereof was produced. This electrophotographic photosensitive member is defined as the "photosensitive member (1)".

Observation of Surface of Electrophotographic Photosensitive Member

The surface of the thus obtained electrophotographic photosensitive member (the photosensitive member (1)) was magnification observed with a laser microscope (manufactured by Keyence Corporation, Trade Name: X-100) using a 50-power lens, and the concave portion and the convex portion provided on the surface of the electrophotographic photosensitive member in the above-described manner were evaluated. During the observation, adjustment was carried out so that the electrophotographic photosensitive member did not incline in the lengthwise direction, and that the apex of the arc of the electrophotographic photosensitive member could be in focus in the peripheral direction. A square region having a side of 500 μm was obtained by linking magnification observed images using an image linking application. Besides, from the thus obtained result, image processing height data was selected using accessory image analysis software and subjected to a filtering process using a filter type median.

Through the observation, the widths of the concave portion and the convex portion, the depth of the concave portion, a distance from the starting point of a rising slope to the end point of a descending slope, a distance from the starting point of the descending slope to the end point of the rising slope, inclinations of the rising slope and the descending slope, whether or not rising slopes of adjacent convex portions are shifted, a shift width between the rising slopes of the adjacent convex portions, and the like were obtained. The results are shown in Table 2.

Incidentally, when the surface of the electrophotographic photosensitive member (the photosensitive member (1)) was observed with another laser microscope (manufactured by Keyence Corporation, Trade Name: X-9500) in substantially the same manner as described above, substantially the same results as those obtained with the above-described laser microscope (manufactured by Keyence Corporation, Trade Name: X-100) were obtained. In production examples described below, surfaces of electrophotographic photosensitive members (photosensitive members (2) to (20), and photosensitive members (101) to (103)) were observed with the laser microscope (manufactured by Keyence Corporation, Trade Name: X-100) using a 50-power lens.

(Production Examples of Photosensitive Members (2) to (20))

Electrophotographic photosensitive members each having a concave portion and a convex portion on the surface thereof were produced in the same manner as in the production example of the photosensitive member (1) except that a used mold was changed as shown in Table 1. The thus obtained electrophotographic photosensitive members were respectively defined as "photosensitive members (2) to (20)". In the same manner as in the production example of the photosensitive member (1), the surfaces of the obtained electrophotographic photosensitive members were observed. The results are shown in Table 2.

TABLE 1

Figure 8:
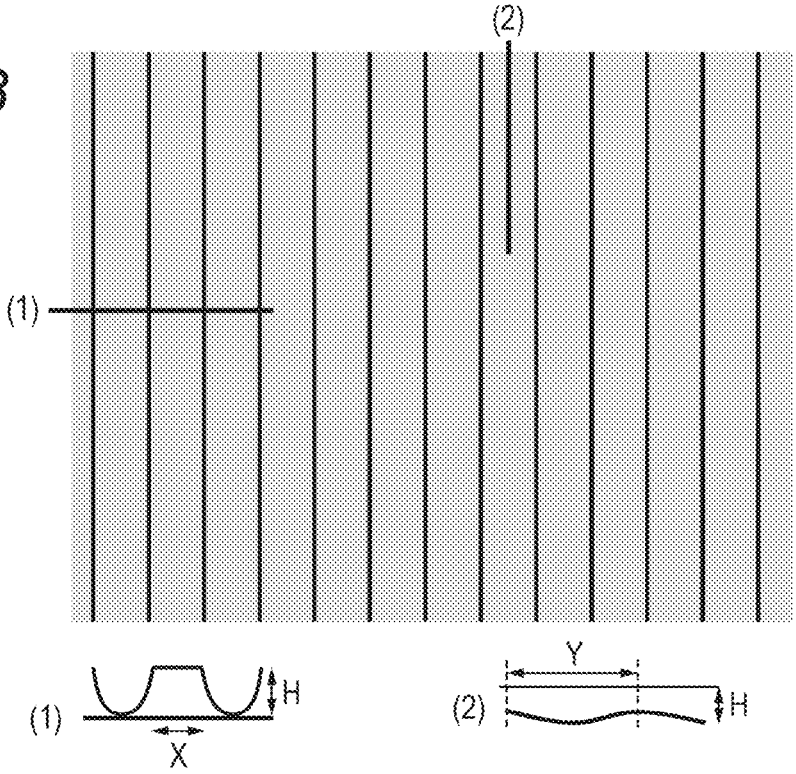
FIG. 8 is a diagram illustrating another example of the mold used in the production example of the electrophotographic photosensitive member.
Figure 9:
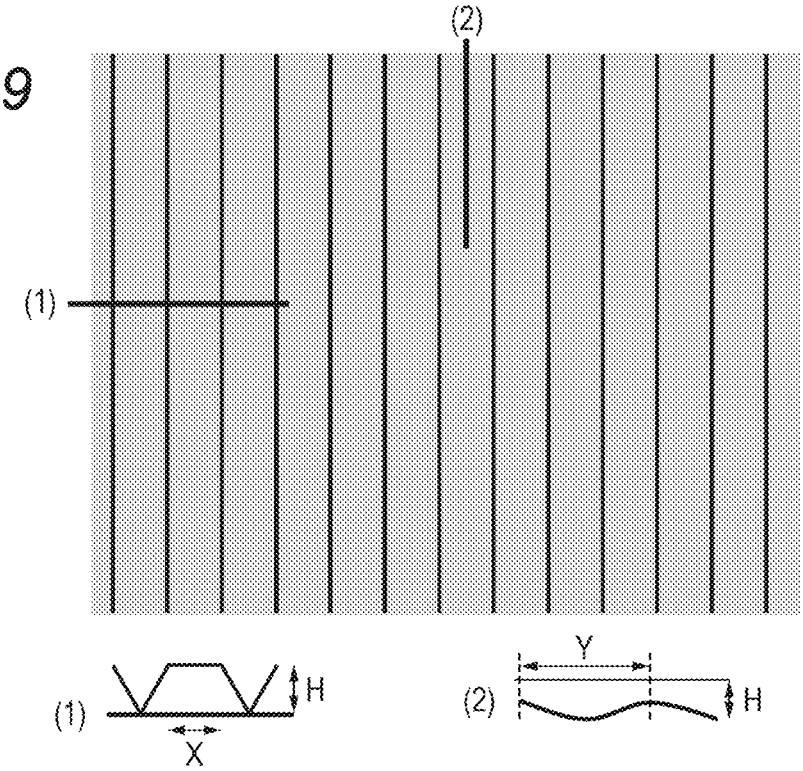
FIG. 9 is a diagram illustrating still another example of the mold used in the production example of the electrophotographic photosensitive member.
Figure 10:
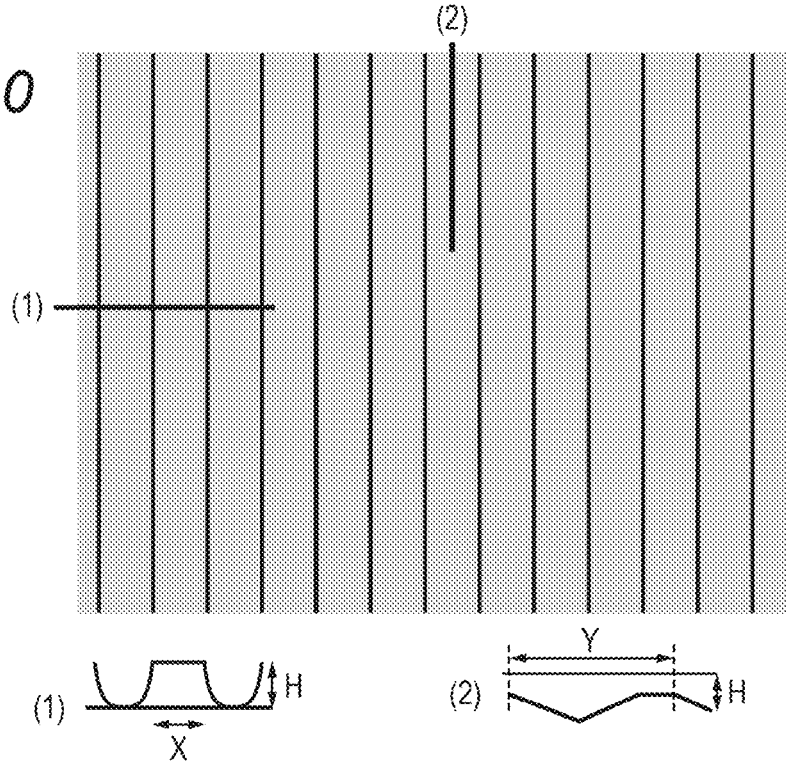
FIG. 10 is a diagram illustrating still another example of the mold used in the production example of the electrophotographic photosensitive member.

| | Mold | | | | | | | |
|---|---|---|---|---|---|---|---|---|
| | Mold Shape | Concave Width μm | Convex Width X μm | Distance from Rising Slope to Descending Slope μm | Distance from Descending Slope to Rising Slope μm | Shift between Descending Slopes of Adjacent Concave Portions | Shift Width between Descending Slopes of Adjacent Concave Portions μm | Molding Height H μm |
| Photosensitive Member-1 | FIG. 7 | 40 | 40 | 80 | 80 | Not shifted | — | 2 to 6 |
| Photosensitive Member-2 | FIG. 7 | 80 | 40 | 300 | 300 | Not shifted | — | 2 to 8 |
| Photosensitive Member-3 | FIG. 7 | 30 | 30 | 80 | 80 | Shifted on one side | 25 | 2 to 6 |
| Photosensitive Member-4 | FIG. 7 | 50 | 20 | 200 | 200 | Shifted on one side | 30 | 2 to 8 |
| Photosensitive Member-5 | FIG. 8 | 30 | 30 | 100 | 100 | Shifted on both sides | 20 | 2 to 6 |
| Photosensitive Member-6 | FIG. 8 | 50 | 50 | 150 | 150 | Shifted on both sides | 30 | 2 to 8 |
| Photosensitive Member-7 | FIG. 8 | 100 | 60 | 300 | 300 | Shifted on both sides | 60 | 7 to 10 |
| Photosensitive Member-8 | FIG. 8 | 60 | 50 | 160 | 160 | Shifted on both sides | 30 | 4 to 8 |
| Photosensitive Member-9 | FIG. 8 | 30 | 30 | 80 | 80 | Shifted on both sides | 25 | 2 to 6 |
| Photosensitive Member-10 | FIG. 8 | 70 | 50 | 100 | 100 | Shifted on both sides | 40 | 2 to 9 |
| Photosensitive Member-11 | FIG. 8 | 30 | 30 | 80 | 80 | Shifted on both sides | 20 | 3 to 5 |
| Photosensitive Member-12 | FIG. 8 | 30 | 30 | 150 | 150 | Shifted on both sides | 25 | 3 to 6 |
| Photosensitive Member-13 | FIG. 9 | 50 | 30 | 300 | 300 | Shifted on both sides | 40 | 4 to 8 |
| Photosensitive Member-14 | FIG. 9 | 30 | 30 | 150 | 150 | Shifted on both sides | 30 | 2 to 6 |
| Photosensitive Member-15 | FIG. 9 | 30 | 30 | 60 | 60 | Shifted on both sides | 20 | 2 to 6 |
| Photosensitive Member-16 | FIG. 9 | 30 | 30 | 60 | 60 | Shifted on both sides | 20 | 4 to 6 |
| Photosensitive Member-17 | FIG. 9 | 70 | 50 | 120 | 120 | Shifted on both sides | 40 | 4 to 8 |
| Photosensitive Member-18 | FIG. 9 | 20 | 30 | 75 | 75 | Shifted on both sides | 20 | 2 to 6 |
| Photosensitive Member-19 | FIG. 10 | 30 | 30 | 110 | 100 | Shifted on both sides | 30 | 2 to 6 |
| Photosensitive Member-20 | FIG. 10 | 50 | 30 | 70 | 60 | Shifted on both sides | 20 | 4 to 7 |

45

TABLE 2

| | Surface of Electrophotographic Photosensitive Member | | | | | | | | |
|---|---|---|---|---|---|---|---|---|---|
| | Concave Width w μm | Convex Width μm | Concave Depth d μm | Distance from Rising Slope to Descending Slope μm | Distance from Descending Slope to Rising Slope μm | Rising Slope ‰ | Descending Slope ‰ | Shift between Rising Slopes of Adjacent Convex Portions | Shift Width between Rising Slopes of Adjacent Convex Portions μm |
| Photosensitive Member-1 | 40 | 40 | 1 to 3 | 80 | 80 | 50 | 50 | Not shifted | — |
| Photosensitive Member-2 | 80 | 40 | 1 to 4 | 300 | 300 | 20 | 20 | Not shifted | — |
| Photosensitive Member-3 | 30 | 30 | 1 to 3 | 80 | 80 | 50 | 50 | Shifted on one side | 25 |
| Photosensitive Member-4 | 50 | 20 | 1 to 4 | 200 | 200 | 30 | 30 | Shifted on one side | 30 |
| Photosensitive Member-5 | 30 | 30 | 1 to 3 | 100 | 100 | 40 | 40 | Shifted on both sides | 20 |

TABLE 2-continued

| | Surface of Electrophotographic Photosensitive Member | | | | | | | | |
|---|---|---|---|---|---|---|---|---|---|
| | Concave Width w μm | Convex Width μm | Concave Depth d μm | Distance from Rising Slope to Descending Slope μm | Distance from Descending Slope to Rising Slope μm | Rising Slope ‰ | Descending Slope ‰ | Shift between Rising Slopes of Adjacent Convex Portions | Shift Width between Rising Slopes of Adjacent Convex Portions μm |
| Photosensitive Member-6 | 50 | 50 | 1 to 4 | 150 | 150 | 40 | 40 | Shifted on both sides | 30 |
| Photosensitive Member-7 | 100 | 60 | 3.5 to 5 | 300 | 300 | 10 | 10 | Shifted on both sides | 60 |
| Photosensitive Member-8 | 60 | 50 | 2 to 4 | 160 | 160 | 25 | 25 | Shifted on both sides | 30 |
| Photosensitive Member-9 | 30 | 30 | 1 to 3 | 80 | 80 | 50 | 50 | Shifted on both sides | 25 |
| Photosensitive Member-10 | 70 | 50 | 1 to 4.5 | 100 | 100 | 70 | 70 | Shifted on both sides | 40 |
| Photosensitive Member-11 | 30 | 30 | 1.5 to 2.5 | 80 | 80 | 25 | 25 | Shifted on both sides | 20 |
| Photosensitive Member-12 | 30 | 30 | 1.5 to 3 | 150 | 150 | 20 | 20 | Shifted on both sides | 25 |
| Photosensitive Member-13 | 50 | 30 | 2 to 4 | 300 | 300 | 10 | 20 | Shifted on both sides | 60 |
| Photosensitive Member-14 | 30 | 30 | 1 to 3 | 150 | 150 | 20 | 40 | Shifted on both sides | 30 |
| Photosensitive Member-15 | 30 | 30 | 1 to 3 | 60 | 60 | 50 | 100 | Shifted on both sides | 20 |
| Photosensitive Member-16 | 30 | 30 | 2 to 3 | 60 | 60 | 25 | 50 | Shifted on both sides | 20 |
| Photosensitive Member-17 | 70 | 50 | 2 to 4 | 120 | 120 | 25 | 50 | Shifted on both sides | 40 |
| Photosensitive Member-18 | 20 | 30 | 1 to 3 | 75 | 75 | 40 | 80 | Shifted on both sides | 20 |
| Photosensitive Member-19 | 30 | 30 | 1 to 3 | 100 | 110 | 40 | 40 | Shifted on both sides | 30 |
| Photosensitive Member-20 | 50 | 30 | 2 to 3.5 | 60 | 70 | 50 | 50 | Shifted on both sides | 20 |

(Evaluation of Electrophotographic Photosensitive Member in Actual Machine)

Example 1

The photosensitive member (1) was loaded in a cyan station of a modified machine of an electrophotographic apparatus (a copying machine) (Trade Name: iR-ADV C5255) manufactured by Canon Inc. used as an evaluation machine, so as to be tested and evaluated as follows.

The initial potential of the electrophotographic photosensitive member was adjusted by setting conditions of a charging device and an image exposing device so that a dark-area potential (Vd) and a light-area potential (Vl) of the electrophotographic photosensitive member could be respectively −500 V and −180 V under an environment of 30° C. and 80% RH.

Next, a cleaning blade made of polyurethane rubber having a hardness of 77° was brought into contact with the surface of the electrophotographic photosensitive member at a contact angle of 28° and a contact pressure of 30 g/cm. With a heater (a drum heater) for the electrophotographic photosensitive member placed in an ON state, 200 sheets of a lateral A4 size evaluation chart having an image with a coverage rate of 1% were continuously output under an environment of 30° C. and 80% RH, and thereafter, a screen image having a cyan density of 30% was output as a halftone image, so as to evaluate the H/H initial streak caused on the image as follows. The results are shown in Table 3.

A: No streak is caused on the image.

B: An image suggestive of a streak is obtained but cannot be definitely determined as a streak.

C: A very slight streak is found on the image but causes no problem in the image.

D: A slight streak is caused on the image but is acceptable.

E: An obvious streak is caused on the image and is not acceptable.

Examples 2 to 20

The electrophotographic photosensitive members shown in Table 3 were respectively evaluated using actual machines in the same manner as in Example 1. The results are shown in Table 3.

TABLE 3

| | Electrophotographic Photosensitive Member | Evaluation Result Streak |
|---|---|---|
| Example 1 | Photosensitive Member -1 | C |
| Example 2 | Photosensitive Member -2 | C |
| Example 3 | Photosensitive Member -3 | B |
| Example 4 | Photosensitive Member -4 | B |
| Example 5 | Photosensitive Member -5 | A |
| Example 6 | Photosensitive Member -6 | A |
| Example 7 | Photosensitive Member -7 | A |
| Example 8 | Photosensitive Member -8 | A |
| Example 9 | Photosensitive Member -9 | A |
| Example 10 | Photosensitive Member -10 | B |
| Example 11 | Photosensitive Member -11 | A |

TABLE 3-continued

| | Electrophotographic Photosensitive Member | Evaluation Result Streak |
|---|---|---|
| Example 12 | Photosensitive Member -12 | A |
| Example 13 | Photosensitive Member -13 | A |
| Example 14 | Photosensitive Member -14 | A |
| Example 15 | Photosensitive Member -15 | A |
| Example 16 | Photosensitive Member -16 | A |
| Example 17 | Photosensitive Member -17 | A |
| Example 18 | Photosensitive Member -18 | A |
| Example 19 | Photosensitive Member -19 | A |
| Example 20 | Photosensitive Member -20 | A |

(Production Examples of Photosensitive Members (101) to (103))

Electrophotographic photosensitive members resulting from the shape transfer under mold pressure were produced as "photosensitive members (101) to (103)" in the same manner as in the production example of the photosensitive member (1) except that molds as shown in Table 4 were respectively used in the production example of the photosensitive member (1). In the same manner as in the production example of the photosensitive member (1), surfaces of these electrophotographic photosensitive members were observed. The results are shown in Table 5.

Comparative Examples 1 to 3

The electrophotographic photosensitive members shown in Table 6 were respectively evaluated using actual machines in the same manner as in Example 1. The results are shown in Table 6.

TABLE 6

| | Electrophotographic Photosensitive Member | Evaluation Result Streak |
|---|---|---|
| Comparative Example 1 | Photosensitive Member -101 | E |
| Comparative Example 2 | Photosensitive Member -102 | E |
| Comparative Example 3 | Photosensitive Member -103 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

TABLE 4

Figure 11:
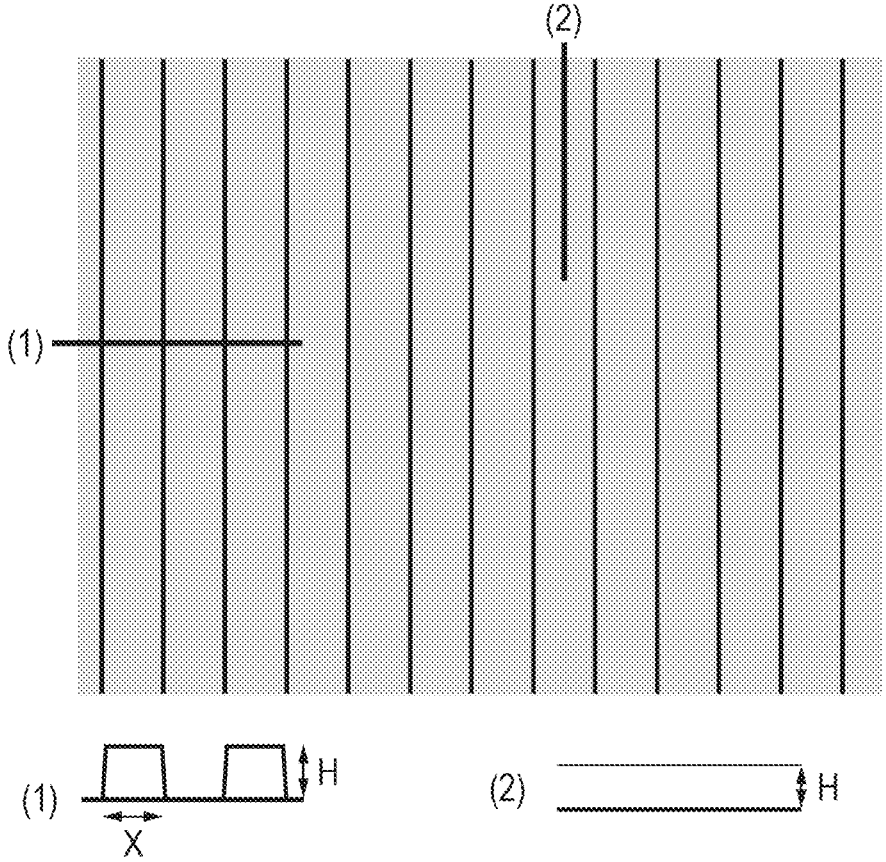
FIG. 11 is a diagram illustrating still another example of the mold used in the production example of the electrophotographic photosensitive member.

| | Mold | | | | | | | |
|---|---|---|---|---|---|---|---|---|
| | Mold Shape | Concave Width μm | Convex Width X μm | Distance from Rising Slope to Descending Slope μm | Distance from Descending Slope to Rising Slope μm | Shift between Descending Slopes of Adjacent Concave Portions | Shift Width between Descending Slopes of Adjacent Concave Portions μm | Molding Height H μm |
| Photosensitive Member-101 | FIG. 11 | 30 | 30 | — | — | — | — | 4 |
| Photosensitive Member-102 | FIG. 11 | 60 | 50 | — | — | — | — | 6 |
| Photosensitive Member-103 | No concave/convex | — | — | — | — | — | — | — |

TABLE 5

| | Surface of Electrophotographic Photosensitive Member | | | | | | | | |
|---|---|---|---|---|---|---|---|---|---|
| | Concave Width w μm | Convex Width μm | Concave Depth d μm | Distance from Rising Slope to Descending Slope μm | Distance from Descending Slope to Rising Slope μm | Rising Slope ‰ | Descending Slope ‰ | Shift between Rising Slopes of Adjacent Convex Portions | Shift Width between Rising Slopes of Adjacent Convex Portions μm |
| Photosensitive Member-101 | 30 | 30 | 2 | — | — | — | — | — | — |
| Photosensitive Member-102 | 60 | 50 | 2.5 | — | — | — | — | — | — |
| Photosensitive Member-103 | — | — | — | — | — | — | — | — | — |

This application claims the benefit of Japanese Patent Application No. 2016-014642, filed Jan. 28, 2016, which is hereby incorporated by reference herein in its entirety.

What is claimed is:

1. An electrophotographic photosensitive member, comprising a convex portion and a concave portion on a surface of the electrophotographic photosensitive member continuously in a peripheral direction of the electrophotographic photosensitive member, and alternately in an axial direction of the electrophotographic photosensitive member, wherein a width w of the concave portion is 30 μm or more and 100 μm or less, a depth d of the concave portion is 1 μm or more and 5 μm or less, the convex portion has a rising slope and a descending slope in the peripheral direction of the electrophotographic photosensitive member, and a distance from a starting point of the rising slope to an end point of the descending slope is 300 μm or less, and a distance from a starting point of the descending slope to an end point of the rising slope is 300 μm or less.

2. The electrophotographic photosensitive member according to claim 1, wherein the convex portion has a maximum rising slope of 70 permil or less.

3. An electrophotographic photosensitive member, comprising a convex portion and a concave portion on a surface of the electrophotographic photosensitive member continuously in a peripheral direction of the electrophotographic photosensitive member, and alternately in an axial direction of the electrophotographic photosensitive member, wherein the convex portion has a rising slope and a descending slope in the peripheral direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

4. The electrophotographic photosensitive member according to claim 3, wherein both the rising slopes of the convex portions adjacent to each other are shifted by 20 μm or more in the axial direction of the electrophotographic photosensitive member.

5. A process cartridge, comprising at least an electrophotographic photosensitive member having a photosensitive layer on a cylindrical support; and a cleaning blade, wherein a surface of the electrophotographic photosensitive member has a convex portion and a concave portion continuously in a peripheral direction of the electrophotographic photosensitive member and alternately in an axial direction of the electrophotographic photosensitive member, a width w of the concave portion is 30 μm or more and 100 μm or less, a depth d of the concave portion is 1 μm or more and 5 μm or less, the convex portion has a rising slope and a descending slope in a rotating direction of the electrophotographic photosensitive member, and a distance from a starting point of the rising slope to an end point of the descending slope is 300 μm or less, and a distance from a starting point of the descending slope to an end point of the rising slope is 300 μm or less.

6. The process cartridge according to claim 5, wherein the convex portion has a maximum rising slope of 70 permil or less.

7. An electrophotographic apparatus comprising: a process cartridge at least including an electrophotographic photosensitive member having a photosensitive layer on a cylindrical support, and a cleaning blade; a charging unit; an exposing unit; a developing unit; and a transfer unit, wherein a surface of the electrophotographic photosensitive member has a convex portion and a concave portion continuously in a peripheral direction of the electrophotographic photosensitive member and alternately in an axial direction of the electrophotographic photosensitive member, a width w of the concave portion is 30 μm or more and 100 μm or less, a depth d of the concave portion is 1 μm or more and 5 μm or less, the convex portion has a rising slope and a descending slope in a rotating direction of the electrophotographic photosensitive member, and a distance from a starting point of the rising slope to an end point of the descending slope is 300 μm or less, and a distance from a starting point of the descending slope to an end point of the rising slope is 300 μm or less.

8. The electrophotographic apparatus according to claim 7, wherein the convex portion has a maximum rising slope of 70 permil or less.

9. A process cartridge, comprising at least an electrophotographic photosensitive member having a photosensitive layer on a cylindrical support; and a cleaning blade, wherein a surface of the electrophotographic photosensitive member has a convex portion and a concave portion continuously in a peripheral direction of the electrophotographic photosensitive member and alternately in an axial direction of the electrophotographic photosensitive member, wherein the convex portion has a rising slope and a descending slope in a rotating direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

10. The process cartridge according to claim 9, wherein both the rising slopes of the convex portions adjacent to each other are shifted by 20 μm or more in the axial direction of the electrophotographic photosensitive member.

11. An electrophotographic apparatus, comprising: a process cartridge at least including an electrophotographic photosensitive member having a photosensitive layer on a cylindrical support, and a cleaning blade; a charging unit; an exposing unit; a developing unit; and a transfer unit, wherein a surface of the electrophotographic photosensitive member has a convex portion and a concave portion continuously in a peripheral direction of the electrophotographic photosensitive member and alternately in an axial direction of the electrophotographic photosensitive member, the convex portion has a rising slope and a descending slope in the rotating direction of the electrophotographic photosensitive member, a distance from a starting point of the rising slope to an end point of the descending slope is 300 μm or less, and a distance from a starting point of the descending slope to an end point of the rising slope is 300 μm or less, and at least one of rising slopes of convex portions adjacent to each other is shifted by 20 μm or more in the axial direction of the electrophotographic photosensitive member.

12. The electrophotographic apparatus according to claim 11, wherein both the rising slopes of the convex portions adjacent to each other are shifted by 20 μm or more in the axial direction of the electrophotographic photosensitive member.

* * * * *